United States Patent [19]

Buday

[11] 4,161,095

[45] Jul. 17, 1979

[54] FLAT ARTICLE STACKING SYSTEM

[75] Inventor: John M. Buday, Des Plaines, Ill.

[73] Assignee: Gard, Inc., Niles, Ill.

[21] Appl. No.: 849,702

[22] Filed: Nov. 8, 1977

[51] Int. Cl.[2] ..... B65B 5/08; B65B 5/10

[52] U.S. Cl. ..... 53/527; 53/542; 53/250; 53/244

[58] Field of Search ..... 53/495, 54, 527, 244, 53/249-251, 534, 542; 93/93 DP; 198/422, 424, 425, 431, 436, 437, 442, 461, 530, 575, 597, 601; 214/7; 271/64, 213, 214, 216, 182, 186

[56] References Cited

U.S. PATENT DOCUMENTS

| | | | |
|---|---|---|---|
| 1,545,910 | 7/1925 | Maxson | 271/202 |
| 2,177,460 | 10/1939 | Renz | 271/199 |
| 2,233,850 | 3/1941 | Rapley | 93/93 DP |
| 2,853,298 | 9/1958 | Faeber | 271/210 |
| 2,856,189 | 10/1958 | Winkler et al. | 271/69 |
| 3,420,149 | 1/1969 | Middleditch et al. | 93/93 C |
| 3,425,184 | 2/1969 | Heliot | 53/501 |
| 3,445,107 | 5/1969 | Stoothoff | 271/177 |
| 3,502,321 | 3/1970 | McWhorter | 270/58 |
| 3,653,656 | 4/1972 | Stobb | 271/185 |
| 3,661,242 | 5/1972 | Clancy | 53/159 X |
| 3,682,329 | 8/1972 | Dean | 214/7 |
| 3,816,972 | 6/1974 | Kemper | 53/534 |
| 3,822,793 | 7/1974 | Stobb | 214/6 H |
| 3,925,962 | 12/1975 | Knopf et al. | 53/124 B |
| 3,932,982 | 1/1976 | Klapp | 214/7 X |

FOREIGN PATENT DOCUMENTS

| | | | |
|---|---|---|---|
| 6618060 | 6/1967 | Netherlands | 214/7 |

*Primary Examiner*—Horace M. Culver
*Attorney, Agent, or Firm*—Vogel, Dithmar, Stotland, Stratman & Levy

[57] ABSTRACT

A system for stacking flat articles into containers having essentially imperforate end walls with the flat articles disposed essentially normal to the bottoms; a stacking conveyor having cooperating pinch belts with an input end for receiving flat articles in a shingled stream, one of the pinch belts at the other end terminating before the other pinch belt to provide a delivery end, a conveyor for moving containers past the delivery end, the delivery end being oriented normal to the bottom of a container and terminating a short distance above the upper edge of the container, stack support structure extending into the associated container and terminating a short distance from the bottom thereof, means for generating a gap in the shingled stream that arrives at the delivery end at the completion of the filling of one container and ends when the next empty container is in position, a following roller disposed adjacent to the delivery end and urging the shingled stream thereagainst, a mechanism for lifting the stacking support structure out of the associated container upon the filling thereof; there also is disclosed a stacking system for use with containers having aligned slots in the ends thereof wherein the delivery end extends downwardly into the associated container and moves through the aligned slots in going from one container to another.

20 Claims, 7 Drawing Figures

100
101
102
103
104
105
106
107
108
109
110
111
115
116
120
125
130
132
134
135
136
138
139
145
146
147
148
150
151
155
160
161
162
163
164
165
166
315
570
572
573
580
581
582
583
584
585
586
587
588
589

FLAT ARTICLE STACKING SYSTEM

BACKGROUND OF THE INVENTION

The present invention relates generally to improvements in systems for stacking shingled streams of flat articles into containers, and particularly to such systems operating in conjunction with a gap generating mechanism that generates a gap in the shingled stream when shifting from the filling of one container to the next.

The present invention is an improvement on the system and machine illustrated in the co-pending application for U.S. Letters Patent, Ser. No. 659,029, filed Feb. 18, 1976, for LEAFLET HANDLING SYSTEM, now abandoned, and the continuation-in-part application based upon said application Ser. No. 659,029, filed Nov. 7, 1977, Ser. No. 849,108.

The system and apparatus of the present invention is capable of handling a wide range of flat articles which may be fed in shingled streams, including sheets of paper, leaflets including several layers of paper, small booklets, envelopes, carton blanks, and the like. However, the present invention is particularly adapted to handling relatively thick flat articles such as assembled carton blanks in the flattened condition thereof. For purposes of illustration, the system has been shown as applied to the handling of such flattened cartons, but it will be understood that various other flat articles can be satisfactorily handled by the system and apparatus.

Flat articles are commonly handled in shingled streams, i.e., streams wherein the individual articles are overlapped for a major portion of the length thereof. Several prior apparatus have been provided for stacking the articles received in a shingled stream, see for example the Maxson U.S. Pat. No. 1,545,910, the Renz U.S. Pat. No. 2,177,460 and the McWhorter U.S. Pat. No. 3,502,321, which all show stacking the leaflets in a horizontal manner. Vertical stacking of articles from a shingled stream is illustrated in the Rapley U.S. Pat. No. 2,223,850, the Faeber U.S. Pat. No. 2,853,298, the Winkler et al. U.S. Pat. No. 2,856,189, and the Klapp U.S. Pat. No. 3,932,982. Vertical stacking of articles from a non-shingled stream is shown in the Rapley U.S. Pat. No. 2,223,850, the Middleditch et al. U.S. Pat. No. 3,420,149, the Heliot U.S. Pat. No. 3,425,184, the Stoothoff U.S. Pat. No. 3,445,107 and Dutch Pat. Application No. 66/18060. Stacking of shingled streams of articles into inclined stacks is illustrated in the Stobb U.S. Pat. Nos. 3,653,656 and 3,822,793. None of these patents however show the stacking of articles from a shingled stream downwardly into containers in an uninterrupted manner.

The typical system for handling the transfer of stacking from one container to another is illustrated in the Dean U.S. Pat. No. 3,682,329 where temporary storage is effected while switching from one container to another. Such a system is inherently slow in operation and further is complicated in construction and operation.

SUMMARY OF THE INVENTION

The present invention provides improved systems for handling shingled streams of flat articles in a more economical, simple and rapid manner.

This is accomplished in the present invention, and it is an object of the present invention to accomplish these desired results, by providing a system for stacking flat articles into containers with the flat articles disposed essentially normal to the bottoms of the containers, the system including a stacking conveyor having cooperating pinch belts for conveying the flat articles in a shingled stream, the stacking conveyor having an input end for receiving flat articles from a source thereof in a shingled stream, one of the pinch belts at the other end of the stacking conveyor terminating before the other pinch belt, the other end of the other pinch belt providing a delivery end for feeding the shingled stream of flat articles from the stacking conveyor, means for moving a continuous line of containers and the delivery end of the stacking conveyor with respect to each other in a continuous manner, the delivery end being oriented essentially normal to the bottom of a container on the container conveyor for feeding the shingled stream of flat articles thereinto, means for generating a gap in the shingled stream of flat articles that arrives at the delivery end at the completion of the filling of one container and ends when the next empty container is in position to receive the shingled stream, a following roller disposed adjacent to the delivery end and urging the shingled stream thereagainst to guide the shingled stream into the associated container, and drive mechanism for the following roller to drive the following roller in a direction to impart an impetus to the flat articles in the shingled stream to feed them into the associated container.

Another object of the invention is to provide a stacking system of the type set forth wherein a tamping mechanism is provided adjacent to the delivery end and engaging the upper ends of the flat articles after delivery thereof into the associated container to insure full insertion thereinto.

Yet another object of the invention is to provide a stacking system of the type set forth that is particularly adapted for use with containers having essentially imperforate end walls, the delivery end terminating a short distance above the upper edge of a container.

Still another object of the invention is to provide a stacking system of the type set forth including stack support structures associated with the delivery end and extending into the associated container and terminating a short distance above the bottom thereof to support the forming stack of flat articles therein, and mechanism for lifting the stacking support structure out of the associated container upon the filling of the associated container and the arrival of a gap in the shingled stream and thereafter placing the stack support structure in the next empty container to begin a new stack therein at the termination of the gap.

A further object of the invention is to provide a stacking system of the type set forth particularly constructed for use with containers having aligned slots in the ends thereof, the delivery end extending into the associated container and terminating a short distance from the bottom thereof and moving through the aligned slots and into the containers when passing from one container to the next.

Further features of the invention pertain to the particular arrangement of the parts of the flat article stacking system, whereby the above outlined and additional operating features thereof are attained.

The invention, both as to its organization and method of operation, together with further features and advantages thereof, will best be understood with reference to the following specification when taken in connection with the accompanying drawings.

DESCRIPTION OF THE PREFERRED EMBODIMENTS

Figures 1, 2, 3:
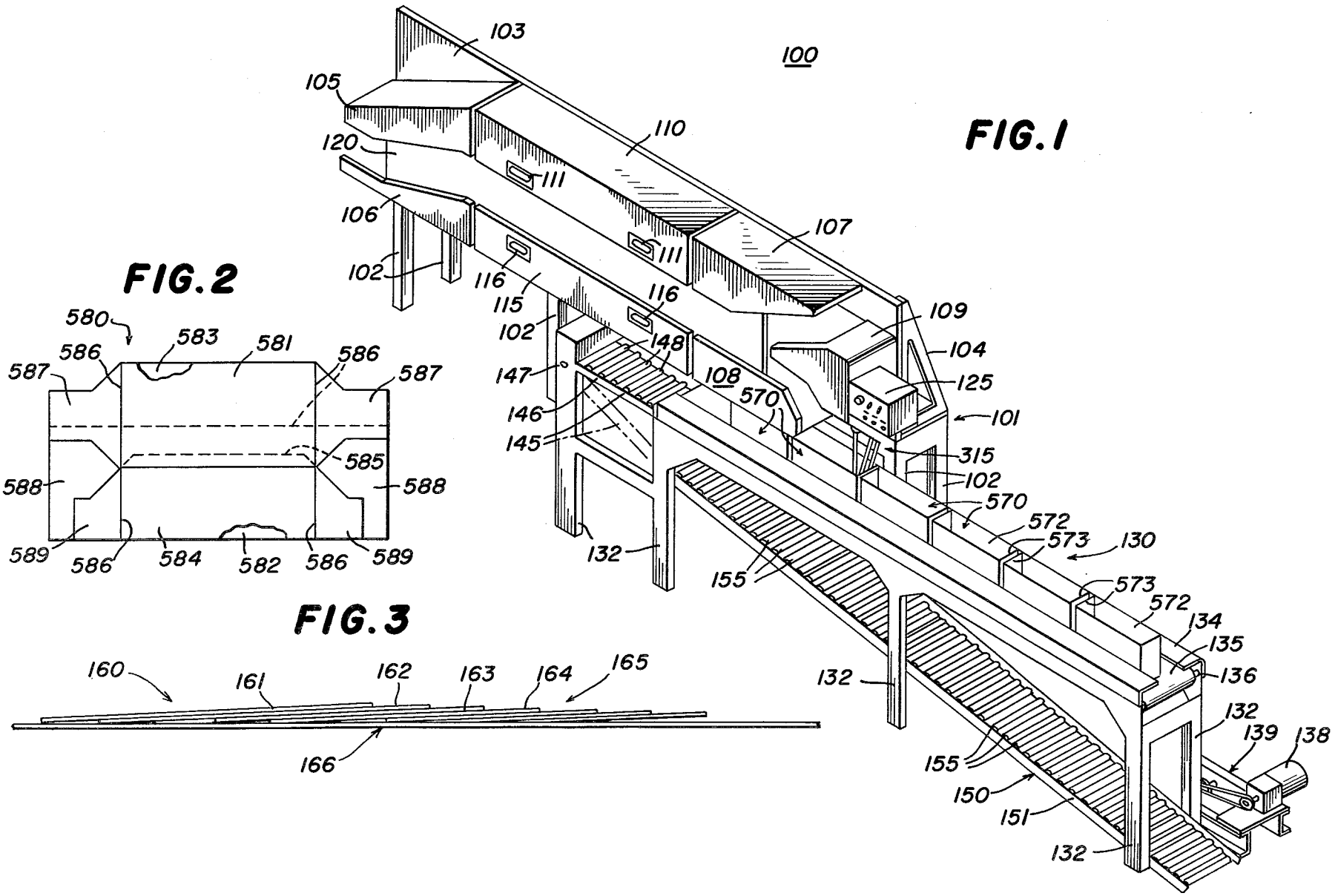
FIG. 1 is a perspective view of a flat article handling machine made in accordance with and embodying the principles of the present invention and having incorporated therein the improved flat article stacking system of the present invention.
FIG. 2 is a plan view of an assembled carton in the flattened condition that is particulary adapted to be handled by the stacking system of the present invention in shingled streams thereof.
FIG. 3 is a diagrammatic illustration of a typical shingled stream of flattened cartons of FIG. 2 as utilized in the present invention.

There is illustrated in FIG. 1 of the drawings a machine 100 for handling shingled streams of flat articles, the machine 100 more particulary embodying the apparatus and method for transporting shingled streams of flat articles, generating gaps in shingled streams of flat articles, and stacking shingled streams of flat articles into containers therefor, all in accordance with and embodying the principles of the present invention. The machine 100 includes a main frame 101 supported at an appropriate vertical position by a plurality of legs 102. A rear plate 103 is provided on which are mounted many of the parts to be described hereinafter, the rear plate 103 being braced as at 104 upon the main frame 101. As illustrated, a plurality of covers are provided over the moving parts of the system including upper and lower infeed covers 105 and 106, upper, intermediate and lower outfeed conveyors 107, 108 and 109 respectively, an upper access panel 110 having a pair of handles 111, a lower access panel 115 having a pair of handles 116 and a front plate 120. Mounted on the frame adjacent to the intermediate outfeed cover 109 is a control panel 125 on which are mounted the several manual operating controls for the machine 100.

An empty container conveyor system generally designated by the numeral 130 is provided to feed empty containers from the right in FIG. 1 toward the left and specifically to a stacking station at the stacking conveyor delivery end 315 just below the control panel 125. The conveyor system 130 includes a frame 131 supported by a plurality of legs 132 and having a pair of opposed guides 134 having the facing edges spaced apart a distance slightly greater than the width of a container to be conveyed by the system 130. Mounted upon the frame 131 is a continuous conveyor belt 135 which is supported and engaged at the right hand end by a drive roller 136 and is supported at the other end by a support roller (not shown). A drive motor 138 is provided for the conveyor belt 135 and has a transmission system 139 that operatively connects the output of the motor 138 to the drive roller 136 so as to operate the conveyor belt 135 in a continuous manner and at a uniform predetermined speed, or alternatively to jog the conveyor belt 135 at a slightly higher speed, as will be described more fully hereinafter. To insure positive engagement between the conveyor belt 130 and the containers disposed thereon, a plurality of pusher bars 140 (see FIGS. 4 and 5 also) are provided and spaced appropriately so as positively to feed the containers one at a time in a continuous line.

The filled containers exit from the left hand end of the conveyor system 130 and move onto a tilting roller conveyor section 145. The roller conveyor section 145 includes a frame 146 that is pivoted as at 147 so that it can move between the solid and dashed line positions illustrated in the drawings, the frame 146 being suitably counterweighted so that it is in the upper solid line position to receive filled containers, and the weight of the filled container pivots the tilting roller conveyor section 145 to the dashed line position. A plurality of rollers 148 is mounted on the frame 146 to facilitate movement of the filled containers therealong.

Tilting the roller conveyor section 145 downwardly to the dashed line positioner thereof feeds the filled container thereon to an outfeed conveyor 150 disposed beneath the conveyor system 130. The outfeed conveyor 150 includes a frame 151 that supports a plurality of rollers 155 that serve to convey the filled containers under the urging of gravity downwardly in FIG. 1 and from left to right.

Referring to FIG. 2 of the drawings, there is illustrated a carton 580 of a type which is particularly adapted to be stacked using the machine of the present invention, the carton 580 being handled in the flattened condition and in a shingled stream as will be discussed more fully hereinafter. Each of the cartons 580 includes a generally rectangular top wall 581 and a generally rectangular bottom wall 582 joined by rectangular side walls 583 and 584. The side wall 584 has integral therewith a glue flap 585 which is glued to the under surface of the top wall 581 to hold the carton 580 in the assembled condition thereof. The various walls mentioned are defined by fold lines 586 which run horizontally and vertically as illustrated in FIG. 2 to define the several parts of the carton 580. The top wall 581 has on either end thereof an integral end flap 587, the bottom wall 582 has like end flaps 588 and the side walls 583 have end flaps 589.

There is diagrammatically illustrated in FIG. 3 of the drawings a shingled stream 160 comprised of individual flat articles, one preferred form of flat article being the carton 580 illustrated in FIG. 2, but it will be understood that other flat articles such as leaflets, can be the articles in the shingled stream 160. The shingled stream 160 is made up of a plurality of individual flat articles 161, 162, etc., consecutive flat articles in the stream overlapping one another over the major portion of their length, the length being defined as the dimension in the direction of motion of the stream 160. With respect to two consecutive flat articles, the preceding one or the leading one is located below, and the one that follows or the trailing one is on top, covering all but the most forward portion of the preceding flat article. For convenience in reference, the upper side in FIG. 3 is referred to as the trailing side 165 of the stream 160 while the lower side in FIG. 3 is referred to as the leading side 166 of the stream 160. The machine of FIG. 1 serves to provide a stack 167 of the leaflets in a container.

Figure 4:
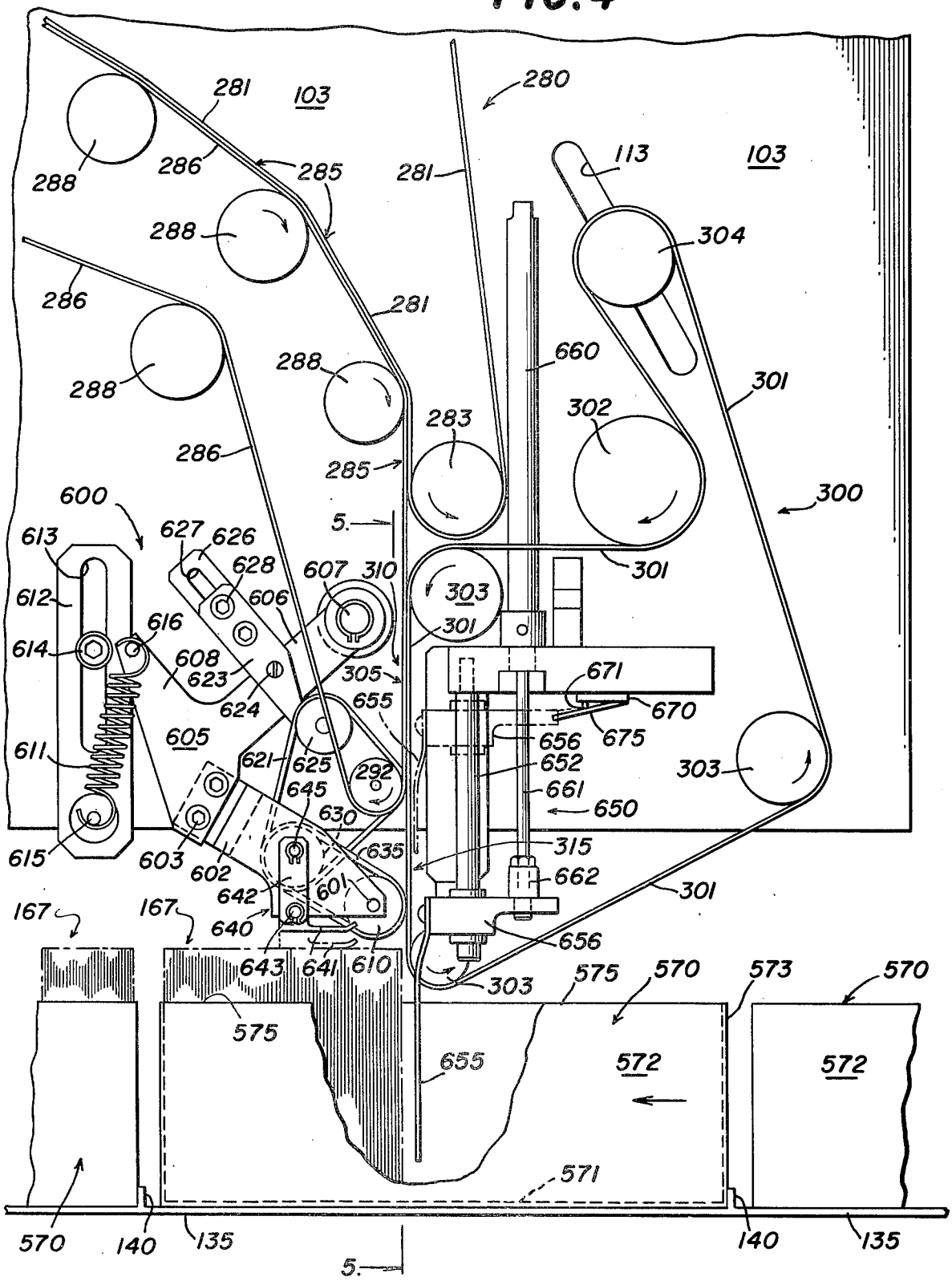
FIG. 4 is an enlarged side elevational view with certain portions broken away showing a first preferred embodiment of a stacking system of the flat article handling machine of FIG. 1.
Figures 5, 6:
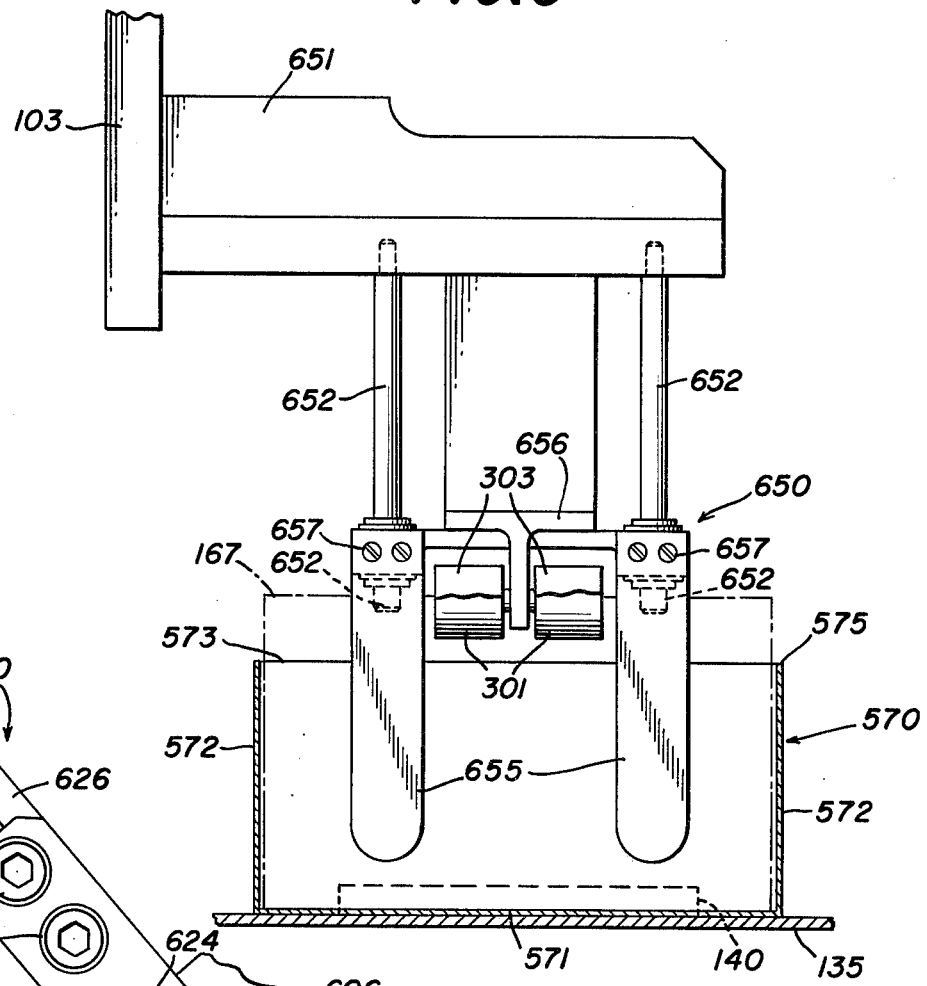
FIG. 5 is the partial view in vertical section along the line 5—5 of FIG. 4.
FIG. 6 is a further enlarged view with certain portions broken away of the following roller drive mechanism forming a part of the stacking system of FIG. 4.

In the form of the invention illustrated in FIGS. 4 to 6 of the drawings, a container 570 is provided formed of chipboard or the like and including a generally rectangular bottom wall 571 having upstanding opposed side walls 572 joined by end walls 573. The end walls 573 are imperforate and the upper edges of the walls 572 and 573 are all on the same level to provide an overall upper edge 575.

Referring to FIGS. 4 to 6 of the drawings, the apparatus for stacking flat articles from a shingled stream 160 into the containers 570 will be described. The shingled stream 160 of flat articles, which may be the flattened cartons 580, is conveyed from a gap generating mechanism which is fully described in detail in the co-pending application Ser. No. 659,029, now abandoned, and the co-pending application Ser. No. 849,108, the entire disclosure of which co-pending patent application is incorporated herein by reference. The shingled stream passes from the gap generating mechanism to a transfer conveyor 280 that includes an upper pinch belt 281 and a lower pinch belt 286 that cooperate to provide adjacent reaches forming conveying sections 285. The upper pinch belt 281 is driven by a drive roller (not shown) and is further supported by several support rollers 283. The lower pinch belt 286 is driven by a drive roller (not shown) and is further supported by a plurality of support rollers 288.

Disposed adjacent to the lower end of the transfer conveyor 280 is the stacking conveyor 300 which includes a continuous pinch belt 301 that is driven by a drive roller 302 and is supported by a plurality of support rollers 303 including an adjustable support roller 304 that can be adjusted along the slot 113 in the rear plate 103. A portion of the pinch belt 301 cooperates with a portion of the pinch belt 286 to provide a vertically arranged conveying section 305 that conveys the shingled stream 160 downwardly and towards the associated container 570. A portion of the vertical reach of the pinch belt 301 extends downwardly below the associated reach of the pinch belt 286 and below the conveying section 305 to provide a delivery end 315. The lowermost portion of the delivery end 315 is disposed slightly above the upper edge 575 of an associated container 570 on the conveyor belt 135.

In order further to support the shingled stream and assure its insertion into the associated container 570 to form the stack 167, there has been provided a following roller mechanism 600 that includes a following roller 610 that engages the exposed or lefthand side of the shingled stream just before entering the stack 167. The roller 610 is journalled upon a shaft 601 mounted between two plates 602 that are secured by bolts 603 to a shiftable frame 605 (see FIG. 6 also). The frame 605 has an arm 606 extending upwardly and to the right as seen in FIGS. 4 and 6 and is pivoted as at 607 on the rear plate 103. Another arm 608 extends upwardly and to the left and is connected to a spring 611 mounted on a plate 612. The plate 612 has slots 613 therein through which extends an attachment bolt 614 adjustably to mount the plate 612 upon the rear plate 103. One end of the spring 611 is connected by a pin 615 to the plate 612 and the other end of the spring 611 is connected by a pin 616 to the arm 608. The spring 611 serves to urge the frame 605 and all of the parts mounted thereon in a counterclockwise direction about the pivot 607, thus to urge the following roller 610 toward the opposite reach of the belt 301 and toward the shingled stream 160 disposed therebetween.

It has been found that the following roller 610 serves to impart a desirable impetus to the shingled stream 160 urging it into the stack 167 if the following roller 610 is positively driven in the direction of the arrow in FIG. 6, i.e., in a clockwise direction. To this end a drive mechanism 620 has been provided including a belt 621 that is driven by the drive roller 292 that in turn is driven by the pinch belt 286. A plate 623 is fixedly secured as by a screw 624 to the arm 606, and a tensioning roller 625 for the belt 621 is journalled on a shaft 629 supported by a plate 626 having a slot 627 therein receiving bolts 628 adjustably to secure the plate 626 to the plate 623. The belt 621 also engages a drive roller 630 journalled on a shaft 631 that is mounted between the plates 602. The drive roller 630 also drives the belt 635 that engages the following roller 610 and serves to drive the following roller 610 in the desired clockwise direction, the belt 635 being in contact with the shingled stream 160 to impart the driving impetus thereto. The linear speed of the belt 635 is essentially equal to the linear speed of travel of the shingled stream 160.

If the shingled stream 160 is made up of flat articles of sufficient stiffness, such as the carton 580 in FIG. 2, and if the flat article is transported with the long edge leading in the shingled stream, such flat articles can be successfully stacked using the delivery end 315 and the cooperating following roller 610, with no additional structure. The insertion of the individual flat articles in the shingled stream 160 into the associated container 570 and into the stack 167 therein is accomplished by positive transport of the flat articles to within a short distance from the bottom of the container 570, since the individual flat articles are supported by the stack 167 and the succeeding flat articles in the shingled stream 160. More specifically, the inertia of the pieces, including the final impetus imparted by the following roller 610 and drive belt 635 in cooperation with the pinch belt 301, together with the coupling force of the shingled stream 160, carries the individual flat articles to the final position resting upon the bottom of the associated container 570.

When the container 570 immediately below the delivery end 315 is about to be filled, a gap is generated in the shingled stream 160 so that no flat articles are delivered while the trailing end of the just filled container 570 is moved by the conveyor belt 135 sufficiently to the left so as to permit the lefthand end of the next empty container 570 to be positioned to receive the shingled stream 160. Termination of the gap resumes feeding of the shingled stream 160 to start forming a new stack 167 in the next empty container 570. The use of the gap in the shingled stream 160 in cooperation with the continuous moving conveyor belt 135 causes an essentially continual filling of the container 570 with the flat articles in the shingled stream 160.

There also has been provided a tamping mechanism 640 for evening the upper ends of the individual flat articles in the stack 167 to further insure complete insertion thereof to the bottom of the associated container 570. The tamping mechanism includes a foot 641 that is connected as by a pivot 643 to a drive arm 642 that extends upwardly and is pivotally connected on a shaft 645 carried by the drive roller 630. The shaft 645 is disposed eccentrically with respect to the axis of rotation of the shaft 631 for the drive roller 630, and as a result, the foot 641 is moved upwardly and downwardly between the positions illustrated in solid lines and dashed lines in FIG. 4. Such movement of the foot 641 serves to tamp or push any of the individual flat articles in the stack 167 into the fully down or inserted position thereof in the associated container 570.

When the individual flat articles in the shingled stream 160 do not have sufficient stiffness to form a self supporting stack 167 or to provide the necessary guide for full insertion of the individual flat articles into the associated container 570, a stack support structure 650 is provided. Referring also to FIG. 5, it will be seen that a mounting bracket 651 is provided on the rear plate 103 and extends forwardly therefrom or to the right as viewed in FIG. 5. The bracket 651 carries two spaced apart depending guide posts 652 which slidably carry a mount 656 for vertical reciprocation therealong. Secured to the mount 656 are two spaced apart fingers 655, secured to the mount 656 by screws 657, the fingers 655 providing support for the forming stack 167 within the associated container 570.

Since the end walls 573 of the container 570 are solid or imperforate, it is necessary to lift the fingers 655 out of a just filled container 570 and thereafter to reinsert the fingers 655 in the next empty container 570. To this end, a finger lift motor 660 has been provided, the motor 660 being pneumatic as illustrated. A control switch (not shown) is provided associated with the conveyor belt 135 that serves to actuate the motor 660 when the trailing or right hand end of a container 570 approaches near to the fingers 655. The motor 660 has a vertically reciprocating shaft 661 which is connected by a connector 662 to the mount 656. Actuation of the motor 660 serves to lift the fingers 655 from the solid line positions illustrated in FIG. 4 to the dashed line positions illustrated therein, whereby to clear the lower ends of the fingers 655 above the upper edge 575 of the container 570. As soon as the next empty container 570 is in position, the motor 660 is actuated to move the fingers 655 from the dashed line positions of FIG. 4 to the solid line positions therein.

In order to increase the efficiency of the stacking system and to minimize the length of the gap that need be generated in the shingled stream 160, a provision has been made to jog or accelerate the conveyor belt 135 upon the completion of the filling of one of the containers 570 thereon. To this end a jog switch 670 has been mounted on the bracket 651 and is provided with the usual actuator 671 and cooperating switch arm 675. The switch arm 675 is positioned to be contacted by the mount 656 as it approaches the uppermost or dashed line position thereof illustrated in FIG. 4. Closure of the jog switch 670 serves to cause the drive motor 138 and the transmission 139 to move the conveyor belt 135 forwardly at a more rapid pace, thus more quickly to position the lefthand end of the next empty container 570 into position to receive the shingled stream 160 from the delivery end 315.

A detailed description of a cycle of operation of the stacking system of FIGS. 4 to 6 will now be given. A shingled stream 160 is being fed by the conveying sections 285 following a gap in the shingled stream 160, one of the empty containers 570 on the conveyor belt 135 having the lefthand end thereof immediately below the delivery end 315 with the fingers 655 inserted therein. The leading edge of the shingled stream 160 passes from the conveyor sections 285 to the conveyor section 305 and then passes the following roller 610 and is driven between the adjacent reach of the pinch belt 301 and the following roller 610 and belt 635 passing therearound. The action of the driven following roller 610 in cooperation with the adjacent reach of the pinch belt 301 provides a driving impetus to the individual flat articles in the shingled stream 160 imparting a positive movement thereto whereby inertia of the moving stream together with the coupling force of the shingled stream carry the individual flat articles to the bottom of the container 570. An accumulation of the flat articles in the shingled stream serves to generate a growing stack 167 with the fingers 655 lending support to the growing stack as required through the adjacent portions of the still moving shingled stream 160. The conveyor belt 135 is moving continuously to the left as viewed in FIG. 4 whereby the stack 167 grows continually until the associated container 570 is filled. It will be noted that during this operation the following roller 610 and the engaged belt 635 are being urged counterclockwise about the pivot 607 and against the engaged shingled stream 160 under the urging of the spring 611.

As the container 570 holding the forming stack 167 approaches the full condition, a gap is generated in the shingled stream 160, so that as the fingers 655 approach the end wall 573 of the associated container 570, the gap arrives and thus interrupts the feeding of flat articles to the stack 167. A switch adjacent to the conveyor belt 135 is actuated at this time thus to actuate the motor 660 to retract the fingers 655 from the solid line positions in FIG. 4 to the dashed line positions therein. As the finger mount 656 approaches the upper end thereof, the switch arm 675 is contacted to actuate the switch 670 which serves to jog the conveyor belt 135 rapidly to move the next empty container 570 into position to receive the shingled stream 160. The motor 660 is actuated then to insert the fingers 655 into the next empty container 570 and shortly thereafter the gap in the shingled stream terminates and feeding of the shingled stream 160 into the container 570 to form a stack 167 is initiated. All the time during the formation of the stack 167, the tamping mechanism 640 is operating to move the foot 641 up and down to push the individual flat articles in the stack 167 to the full down position against the bottom 571 of the container 570.

Figure 7:
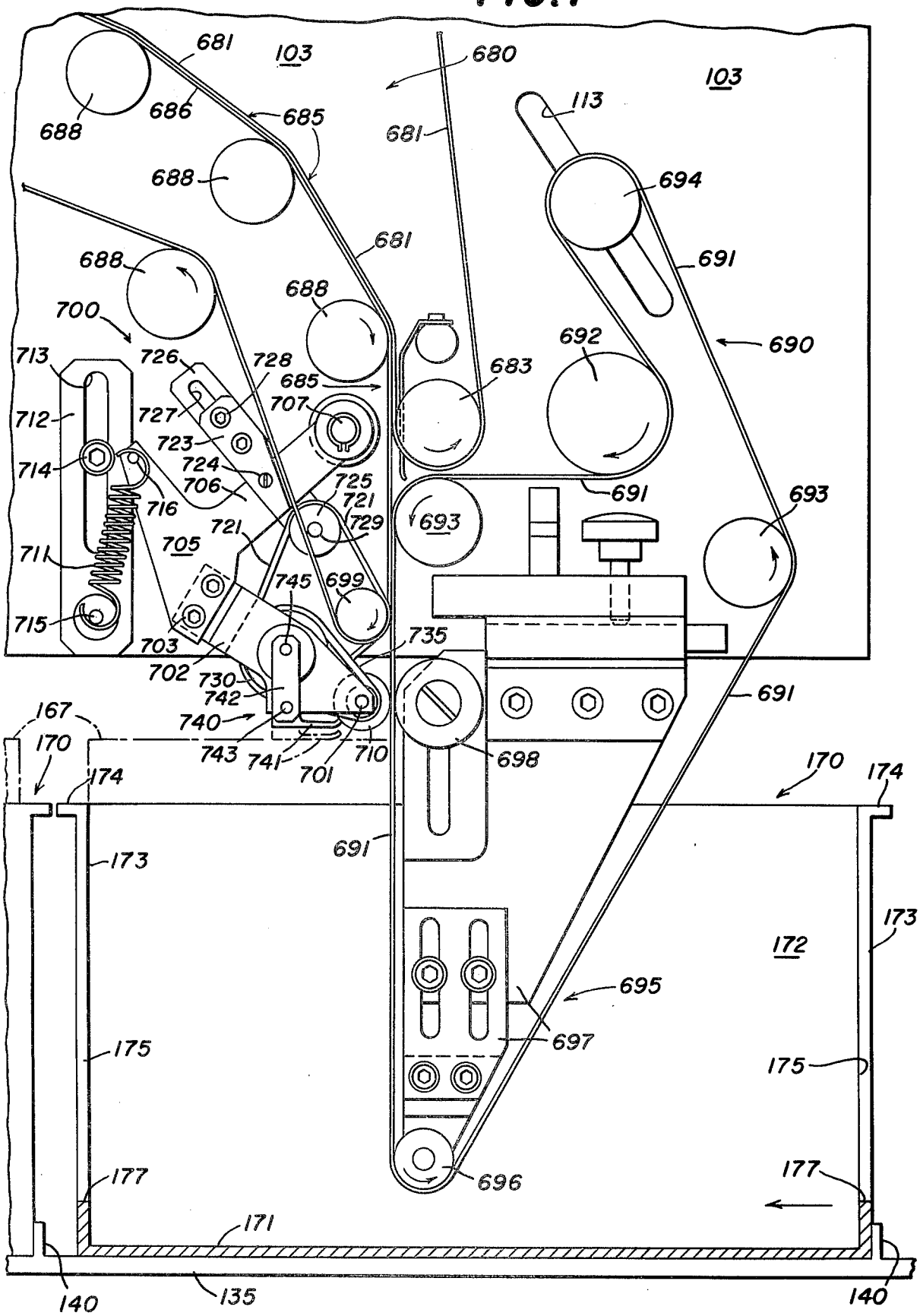
FIG. 7 is a view similar to FIG. 4 showing a second preferred embodiment of a stacking system made in accordance with and embodying the principles of the present invention.

There is illustrated in FIG. 7 of the drawings a second preferred embodiment of the stacking system made in accordance with the present invention, this embodiment being intended for use with a container 170 having aligned slots in the end walls thereof to accommodate the passage of delivery mechanism therethrough when going from a just filled container to the next empty container. The container 170 is preferably integral and molded of plastic, a suitable plastic being polyethylene. As illustrated, the container 170 includes a generally rectangular bottom wall 171 that integrally carries a pair of opposed side walls 172 and a pair of opposed end walls 173, all integrally joined at the junctures therebetween. The upper edges of the several walls carry a rim 174 that extends outwardly and is disposed essentially parallel to the bottom wall 171. The end walls 173 are each provided with a generally rectangular slot 175 therein, the side edges of the slots 175 being spaced apart to receive mechanism therethrough that will be described more fully hereinafter, and being spaced inwardly from the adjacent juncture with the adjacent side wall 172. The bottom edge 177 of each of the slots 175 is disposed substantially parallel to the bottom wall 171 and is spaced upwardly therefrom a short distance, whereby the portions of the end walls 173 that remain are adequate to hold the adjacent end of a stack 167. Further details of construction of the container 170 are set forth in the co-pending application Ser. No. 659,029, and the disclosure thereof is incorporated herein by reference.

A shingled stream 160 is fed from the gap generating mechanism to a transfer conveyor 680 illustrated in FIG. 7 of the drawings. The transfer conveyor 680 includes an upper pinch belt 681 and a lower belt 686 that cooperate to provide adjacent reaches forming conveying sections 685. The upper pinch belt 681 is driven by a drive roller (not shown) and is further supported by several support rollers 683. The lower pinch belt 686 is driven by a drive roller (not shown) and is further supported by a plurality of support rollers 688.

The lowermost conveying section 685 is oriented essentially vertically and the pinch belt 681 terminates thereat. Disposed adjacent to the lowermost reach of the lower pinch belt 686 is a stacking conveyor 690 that includes a pinch belt 691 cooperating with the lower reach of the pinch belt 686 to form a conveying section directed essentially vertically. The pinch belt 691 is driven by a drive roller 692 and further is supported by a plurality of support rollers 693 that are fixed and an adjustable support roller 694 that can be moved along the slot 113 to provide for adjustment of the tension in the belt 691. The lower portion of the pinch belt 691 is passed over a delivery roller 696 to provide a delivery end 695 for the stacking conveyor 690. The delivery roller 696 is journalled in an adjustable frame 697 mounted on the rear plate 103 and extending downwardly into an associated container 170 and being shaped and arranged so that it can pass through the aligned slots 175 in the end walls 173 as the containers 170 are conveyed thereby on the conveyor belt 135.

Associated with and cooperating to feed the shingled stream 160 is a following roller mechanism 700 that is essentially constructed and arranged like the following roller mechanism 600 described above. Accordingly, like reference numerals in the 700 series corresponding to those reference numerals in the 600 series have been applied to parts in the following roller mechanism 700 that correspond to the like parts in the following roller mechanism 600. It is pointed out that the drive roller 292 in the following roller mechanism 600 has been replaced by a drive roller 699 in the following roller mechanism 700, the belt 735 in the following roller mechanism 700 does not engage the shingled stream 160 as does the corresponding belt 635 in the following roller mechanism 600, and the following roller 710 rotates at a substantially faster speed than does the following roller 610. Except for these differences in construction, the construction of the following roller mechanism 700 is identical to that of the following roller mechanism 600, the construction and operation of the following roller 710 is identical to that of the following roller 610, the construction and operation of the drive mechanism 720 is identical to that of the drive mechanism 620, the construction and operation of the drive roller 730 is identical to that of the drive roller 630, as are all of the associated parts, whereby the description thereof will not be repeated in the interest of brevity. Likewise, the tamping mechanism 740 is constructed and operates like the tamping mechanism 640 described above, whereby that description also will not be repeated.

There further is provided in FIG. 7 a back-up roller 698 that is disposed laterally opposite the following roller 710 so as to provide back-up therefor and to increase the effectiveness of the following roller 710 in feeding the shingled stream 160 into the container 170.

A cycle of operation of the stacking system of FIG. 7 will now be given. A supply of the containers 170 is placed upon the conveyor belt 135 and a shingled stream 160 of flat articles is fed to the transfer conveyor 680, gaps being generated in the shingled stream 160 at intervals that correspond to a full stack 167 in one of the containers 170. As the leading flat article after a gap in the shingled stream 160 is fed along the conveying section 685, the left hand end of a container 170 is disposed just a short distance away from the delivery end 695, specifically the lowermost reach disposed to the left and above the delivery roller 696. The shingled stream 160 is fed by the following roller 710 and the adjacent reach of the pinch belt 691 downwardly and almost to the bottom of the container 170, the inertia imparted by the following roller 710 and the coupling force of the shingled stream 160 aiding in carrying the individual flat articles to the bottom 171 of the container 170. The conveyor belt 135 is moving continuously to the left at a speed such that the stack 167 is formed and grows at the same speed as that of movement of the containers 170. The tamping mechanism 740 serves to push each individual flat article in the stack 167 to the lowermost position thereof.

As the stack 167 approaches the righthand end wall 173 of the container 170, a gap is generated in the shingled stream 160 and the gap arrives at the following roller 710 as the delivery end 695 is about to exit from the just-filled container 170. At this time the conveyor belt 135 is preferably jogged quickly to place the next empty container 170 in position with the lefthand portion of the lowermost reach of the pinch belt 691 disposed just to the right of the inner surface of the lefthand end wall 173. The leading edge of the shingled stream 160 is now fed past the following roller 710 and into the container 170, thus to repeat the stacking operation.

While there have been described what are at present considered to be the preferred embodiments of the invention, it will be understood that various modifications may be made therein, and it is intended to cover in the appended claims all such modifications that fall within the true spirit and scope of the invention.

What is claimed is:

1. A system for stacking flat articles into containers with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof in a shingled stream, one of said pinch belts at the other end of said stacking conveyor terminating before the other pinch belt, the other end of said other pinch belt providing a delivery end for feeding the shingled stream of flat articles from said stacking conveyor, means for moving a continuous line of containers and the delivery end of said stacking conveyor with respect to each other in a continuous manner, said delivery end being oriented essentially normal to the bottom of a container on said container conveyor for feeding the shingled stream of flat articles thereinto, means for generating a gap in the shingled stream of flat articles that arrives at said delivery end at the completion of the filling of one container and ends when the next empty container is in position to receive the shingled stream, a following roller disposed adjacent to said delivery end and urging the shingled stream thereagainst to guide the shingled stream into the associated container, and drive mechanism for said following roller to drive said following roller in a direction to impart an impetus to the flat articles in the shingled stream to feed them into the associated container.

2. The system for stacking set forth in claim 1, wherein said means for moving is a container conveyor operated at a speed equal to the speed that a stack is formed in a container thereon.

3. The system for stacking set forth in claim 1, wherein said following roller is disposed above the bottom of the container a distance at least equal to the length of a flat article.

4. The system for stacking set forth in claim 1, wherein said delivery end terminates above the top of an associated container.

5. The system for stacking set forth in claim 1, wherein said delivery end terminates above the bottom of an associated container.

6. The system for stacking set forth in claim 1, wherein said following roller continuously and resiliently urges the shingled stream against the delivery end.

7. A system for stacking flat articles into containers with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof in a shingled stream, one of said pinch belts at the other end of said stacking conveyor terminating before the other pinch belt, the other end of said other pinch belt providing a delivery end for feeding the shingled stream of flat articles from said stacking conveyor, means for moving a continuous line of containers and the delivery end of said stacking conveyor with respect to each other in a continuous manner, said delivery end being oriented essentially normal to the bottom of a container on said container conveyor for feeding the shingled stream of flat articles thereinto, means for generating a gap in the shingled stream of flat articles that arrives at said delivery end at the completion of the filling of one container and ends when the next empty container is in position to receive the shingled stream, a following roller disposed adjacent to said delivery end and urging the shingled stream thereagainst to guide the shingled stream into the associated container, drive mechanism for said following roller to drive said following roller in a direction to impart an impetus to the flat articles in the shingled stream to feed them into the associated container, and tamping mechanism adjacent to said delivery end and engaging the upper ends of the flat articles after delivery thereof into the associated container to insure full insertion thereinto.

8. The system for stacking set forth in claim 7, wherein said tamping mechanism is driven by said drive mechanism that drives said following roller.

9. The system for stacking set forth in claim 7, wherein said tamping mechanism is resiliently urged against the upper end of the flat articles.

10. A system for stacking flat articles into containers having essentially imperforate end walls with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof in a shingled stream, one of said pinch belts at the other end of said stacking conveyor terminating before the other pinch belt, the other end of said other pinch belt providing a delivery end for feeding the shingled stream of flat articles from said stacking conveyor, means for moving a continuous line of containers and the delivery end of said stacking conveyor with respect to each other in a continuous manner, said delivery end being oriented essentially normal to the bottom of a container on said container conveyor and terminating a short distance above the upper edge of a container, means for generating a gap in the shingled stream of flat articles that arrives at said delivery end at the completion of the filling of one container and ends when the next empty container is in position to receive the shingled stream, a following roller disposed adjacent to said delivery end and urging the shingled stream thereagainst to guide the shingled stream into the associated container, and drive mechanism for said following roller to drive said following roller in a direction to impart an impetus to the flat articles in the shingled stream to feed them into the associated container.

11. The system for stacking set forth in claim 10, wherein said means for moving is a container conveyor operated at a speed equal to the speed that a stack is formed in a container thereon.

12. The system for stacking set forth in claim 10, wherein said following roller is disposed above the bottom of the container a distance at least equal to the length of a flat article.

13. The system for stacking set forth in claim 10, wherein said following roller continuously and resiliently urges the shingled stream against the delivery end.

14. The system for stacking set forth in claim 10, and further comprising tamping mechanism adjacent to said delivery end and engaging the upper ends of the flat articles after delivery thereof into the associated container to insure full insertion thereinto.

15. A system for stacking flat articles into containers having essentially imperforate end walls with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof in a shingled stream, one of said pinch belts at the other end of said stacking conveyor terminating before the other pinch belt, the other end of said other pinch belt providing a delivery end for feeding the shingled stream of flat articles from said stacking conveyor, means for moving a continuous line of containers and the delivery end of said stacking conveyor with respect to each other in a continuous manner, said delivery end being oriented essentially normal to the bottom of a container on said container conveyor and terminating a short distance above the upper edge of a container, stack support structure associated with said delivery end and extending into the associated container and terminating a short distance from the bottom thereof to support the forming stack of flat articles therein, means for generating a gap in the shingled stream of flat articles that arrives at said delivery end at the completion of the filling of one container and ends when the next empty container is in position to receive the shingled stream, a following roller disposed adjacent to said delivery end and urging the shingled stream thereagainst to guide the shingled stream toward said stack support structure and into the associated container, and mechanism for lifting said stack support structure out of the associated container upon the filling of the associated container and the arrival of a gap in the shingled stream and thereafter placing the stack support structure in the next empty container to begin a new stack therein at the termination of the gap.

16. The system for stacking set forth in claim 15, wherein said stack support structure includes two spaced-apart fingers engaging the forming stack and associated container.

17. The stacking system set forth in claim 15, and further comprising drive mechanism for said following roller to drive said following roller in a direction to impart an impetus to the flat articles in the shingled stream to feed them into the associated container.

18. The system for stacking set forth in claim 15, and further comprising tamping mechanism adjacent to said delivery end and engaging the upper ends of the flat articles after delivery thereof into the associated container to insure full insertion thereinto.

19. A system for stacking flat articles into containers having aligned slots in the ends thereof with the flat articles disposed essentially normal to the bottoms of the containers, said system comprising a stacking conveyor including cooperating pinch belts for conveying the flat articles in a shingled stream, said stacking conveyor having an input end for receiving flat articles from a source thereof in a shingled stream, one of said pinch belts at the other end of said stacking conveyor terminating before the other pinch belt, the other end of said other pinch belt providing a delivery end for feeding the shingled stream of flat articles from said stacking conveyor, means for moving a continuous line of containers and the delivery end of said stacking conveyor with respect to each other in a continuous manner, said delivery end being oriented essentially normal to the bottom of a container on said container conveyor and extending into the associated container and terminating a short distance from the bottom thereof, means for generating a gap in the shingled stream of flat articles that arrives at said delivery end at the completion of the filling of one container and ends when the next empty container is in position to receive the shingled stream, a following roller disposed above the upper edge of a container and adjacent to said delivery end for urging the shingled stream thereagainst to guide the shingled stream into the associated container, and drive mechanism for said following roller to drive said following roller in a direction to impart an impetus to the flat articles in the shingled stream to feed them into the associated container.

20. The system for stacking set forth in claim 19, and further comprising tamping mechanism adjacent to said delivery end and engaging the upper ends of the flat articles after delivery thereof into the associated container to insure full insertion thereinto.

* * * * *